US011396442B2

(12) United States Patent
Wu et al.

(10) Patent No.: US 11,396,442 B2
(45) Date of Patent: Jul. 26, 2022

(54) LOW COST ROPED JUMP LIFT CONCEPT

(71) Applicant: Otis Elevator Company, Farmington, CT (US)

(72) Inventors: Jianfeng Wu, Huzhou (CN); Ming Chen, Zhejiang (CN); Shan Li, Zhejiang (CN); Hong Chen, Zhejiang (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 17/098,012

(22) Filed: Nov. 13, 2020

(65) Prior Publication Data

US 2021/0347610 A1 Nov. 11, 2021

(30) Foreign Application Priority Data

May 9, 2020 (CN) ..... 202010385859.4

(51) Int. Cl.

| | |
|---|---|
| ***B66B 19/00*** | (2006.01) |
| ***B66B 9/00*** | (2006.01) |
| ***B66B 11/00*** | (2006.01) |

(52) U.S. Cl.

CPC ..... *B66B 19/00* (2013.01); *B66B 9/00* (2013.01); *B66B 11/004* (2013.01)

(58) Field of Classification Search

CPC ..... B66B 19/002; B66B 19/02; B66B 19/005
See application file for complete search history.

(56) References Cited

U.S. PATENT DOCUMENTS

| | | | | |
|---|---|---|---|---|
| 3,519,101 | A | 7/1970 | Sieffert | |
| 9,388,020 | B2 * | 7/2016 | Peacock | B66B 19/00 |
| 10,227,212 | B2 * | 3/2019 | Alasentie | B66B 7/062 |
| 10,252,890 | B2 | 4/2019 | Ratia et al. | |
| 10,501,289 | B2 | 12/2019 | Rasanen et al. | |
| 2008/0308362 | A1 | 12/2008 | Tucker | |

(Continued)

FOREIGN PATENT DOCUMENTS

| | | | |
|---|---|---|---|
| CN | 1236992 | C | 1/2006 |
| CN | 1313349 | C | 5/2007 |
| CN | 1962387 | A | 5/2007 |

(Continued)

OTHER PUBLICATIONS

KONE "KONE Jumplift Brochure", KONE Corporation, 2016, 12 pages.

*Primary Examiner* — Diem M Tran
(74) *Attorney, Agent, or Firm* — Cantor Colburn LLP

(57) ABSTRACT

A jumping elevator system and a jumping method used in construction process of building. The jumping method includes preliminarily positioning and mounting, by means of a temporary working platform at a first height, a guide rail on the hoistway substantially corresponding to the first height; removing the temporary working platform from the position, corresponding to the first height, of the hoistway; lifting, by use of a lifting assembly, a jumping platform from a second height to a third height, wherein the third height is greater than the second height and less than or equal to the first height; and lifting, by use of the lifting assembly, the elevator car to extend its traveling distance in the hoistway, and operating, during lifting of the elevator car, on the top of the elevator car for reinforcing the mount of the guide rail.

17 Claims, 9 Drawing Sheets

(56) References Cited

U.S. PATENT DOCUMENTS

| | | | |
|---|---|---|---|
| 2012/0023863 | A1 | 2/2012 | Van Der Meijden et al. |
| 2020/0062549 | A1* | 2/2020 | Kim ..... B66B 19/00 |

FOREIGN PATENT DOCUMENTS

| | | | | |
|---|---|---|---|---|
| CN | 102325714 | A | | 1/2012 |
| CN | 102341336 | A | | 2/2012 |
| CN | 101535165 | B | | 5/2012 |
| CN | 101573285 | B | | 5/2012 |
| CN | 101801834 | B | | 10/2012 |
| CN | 102762484 | A | | 10/2012 |
| CN | 103025640 | A | | 4/2013 |
| CN | 103303771 | A | | 9/2013 |
| CN | 103339052 | A | | 10/2013 |
| CN | 104024141 | A | | 9/2014 |
| CN | 104066670 | A | | 9/2014 |
| CN | 102666345 | B | | 8/2015 |
| CN | 105358468 | A | | 2/2016 |
| CN | 106144843 | A | | 11/2016 |
| CN | 106660748 | A | | 5/2017 |
| CN | 104955760 | B | | 6/2018 |
| CN | 108137282 | A | | 6/2018 |
| CN | 103402901 | B | | 12/2018 |
| CN | 109019209 | A | | 12/2018 |
| CN | 109476463 | A | | 3/2019 |
| CN | 110023229 | A | | 7/2019 |
| CN | 209052240 | U | | 7/2019 |
| CN | 209052240 | U | * | 7/2019 |
| CN | 209396744 | U | | 9/2019 |
| CN | 107428503 | B | | 10/2019 |
| CN | 110498321 | A | | 11/2019 |
| CN | 110844743 | A | | 2/2020 |
| CN | 108367897 | B | | 4/2020 |
| EP | 1708555 | B1 | | 7/2007 |
| EP | 2650248 | A | | 10/2013 |
| EP | 2349902 | B1 | | 11/2013 |
| EP | 2435350 | B1 | | 3/2017 |
| FR | 2694279 | A1 | | 2/1994 |
| JP | 01075384 | A | * | 3/1989 |
| JP | 09202563 | A | * | 8/1997 |
| JP | 10316331 | A | * | 12/1998 |
| JP | H10316331 | A2 | | 12/1998 |
| JP | 2862681 | B2 | | 3/1999 |
| JP | 5278966 | B2 | | 9/2013 |
| WO | 0007923 | A1 | | 2/2000 |
| WO | WO-0007923 | A1 | * | 2/2000 |
| WO | WO-2011048275 | A1 | * | 4/2011 |
| WO | WO-2011080387 | A1 | * | 7/2011 ..... B66B 19/00 |
| WO | 2018091597 | A1 | | 5/2018 |
| WO | 2020035930 | A1 | | 2/2020 |
| WO | 2020035933 | A1 | | 2/2020 |
| WO | 2020044444 | A1 | | 3/2020 |
| WO | 2020059951 | A1 | | 3/2020 |
| WO | 2020064316 | A1 | | 4/2020 |

* cited by examiner

LOW COST ROPED JUMP LIFT CONCEPT

FOREIGN PRIORITY

This application claims priority to Chinese Patent Application No. 202010385859.4, filed May 9, 2020, and all the benefits accruing therefrom under 35 U.S.C. § 119, the contents of which in its entirety are herein incorporated by reference.

FIELD OF THE INVENTION

The invention pertains to the technical field of elevator, and relates to a jumping elevator system and a jumping method used in a construction process of a building.

BACKGROUND OF THE INVENTION

In a construction process of a building, materials and/or workers need to be conveyed up and down between floors basically built well. Under such need, a jumping elevator (or referred to as jumping lift) system is typically used in the construction process of the building; with an elevator car of the jumping elevator system traveling up and down in a well-built hoistway (or referred to as a lift shaft) of the building, materials and/or workers can be conveniently conveyed between different landings. Also, as the construction process of the building advances continuously, the height or level of the hoistway also advances gradually, and the traveling height of the elevator car of the jumping elevator system in the hoistway also needs to be increased continuously, generally through a jumping platform.

Known conventional elevator systems typically use ropes for lifting, and generally require an elevator machine room to be provided to accommodate drives such as tractor to pull the ropes, thereby lifting the elevator car. Therefore, corresponding space is leaved generally in the hoistway (e.g., at the top of the hoistway) of the building to provide the elevator machine rooms.

For a jumping elevator system, an elevator machine room also needs to be provided to contain a tractor and the like. At present, the elevator machine room of the jumping elevator system is generally arranged in a hoist, and even the elevator machine room is arranged on a jumping platform and can jump along with the jumping platform.

Moreover, before the jumping platform jumps up, guide rails need to be extended and newly extended guide rails need to be positioned and mounted on the hoistway, thereby preparing for extending traveling height of elevator car.

SUMMARY OF THE INVENTION

According to an aspect of the disclosure, a jumping method of a jumping elevator system centrifugal compressor is provided and comprises: preliminarily positioning and mounting, by means of a temporary working platform at a first height, a guide rail on the hoistway substantially corresponding to the first height; removing the temporary working platform from the position, corresponding to the first height, of the hoistway; lifting, by use of a lifting assembly, a jumping platform from a second height to a third height, wherein the third height is greater than the second height and less than or equal to the first height; and lifting, by use of the lifting assembly, the elevator car to extend its traveling distance in the hoistway, and operating, during lifting of the elevator car, on the top of the elevator car for reinforcing the mount of the guide rail In accordance with an additional or alternative embodiment, the method further comprises: positioning and mounting, prior to the preliminary positioning and mounting of the guide rail, the temporary working platform on a landing corresponding to the first height by a first upright.

In accordance with an additional or alternative embodiment, the method further comprises: reloading, prior to lifting the elevator car, the lifting assembly on the elevator car from the jumping platform.

In accordance with an additional or alternative embodiment, the method further comprises: fixing, prior to lifting the jumping platform, the elevator car to the guide rail below the second height; and releasing, prior to lifting the elevator car, the fixation of the elevator car relative to the guide rail.

In accordance with an additional or alternative embodiment, the method further comprises: fixing, prior to lifting the jumping platform, a counterweight in the hoistway; and releasing the fixation of the counterweight after lifting the elevator car.

According to another aspect of the disclosure, a jumping elevator system used in a construction process of a building is provided and includes: an elevator car capable of traveling up and down along a guide rail in a hoistway of the building; a counterweight disposed in the hoistway; a jumping platform capable of jumping along with an increase of height of the hoistway; an elevator machine room which is independently arranged relative to the jumping platform and is incapable of jumping along with the jumping platform; a temporary working platform which is independently arranged relative to the jumping platform and is provided for preliminarily positioning and mounting the guide rail relative to the hoistway prior to lifting the jumping platform; and a lifting assembly provided for lifting the jumping platform to a higher height when the height of the hoistway is increased, and further lifting the elevator car after lifting the jumping platform so as to extend its traveling distance in the hoistway In accordance with an additional or alternative embodiment, the elevator machine room is fixed on a landing outside of the hoistway; the jumping elevator system further includes a pulley assembly which at least comprises a rope, a top guide sheave and a bottom guide sheave; wherein the top guide sheave is arranged on the jumping platform and is capable of jumping along with the jumping platform, the top guide sheave and the bottom guide sheave are arranged to guide the rope to extend at least from the hoistway toward a traction sheave in the elevator machine room outside of the hoistway.

In accordance with an additional or alternative embodiment, the top guide sheave and the bottom guide sheave are further arranged to guide the rope to extend at least from a top of the elevator car in the hoistway toward the traction sheave in the elevator machine room outside of the hoistway such that a tractor can transmit a traction force to the top of the elevator car through the pulley assembly.

In accordance with an additional or alternative embodiment, the pulley assembly further comprises a roof pulley provided at the top of the elevator car; the top guide sheave and the bottom guide sheave are further arranged to guide the rope to extend at least from the roof pulley toward the traction sheave in the elevator machine room outside of the hoistway such that the tractor can transmit a traction force to the top of the elevator car through the pulley assembly.

In accordance with an additional or alternative embodiment, a first end of the rope is secured to the jumping platform, the rope extends downwards from the first end, wraps through the roof pulley, extends upwards and wraps through a first top guide sheave of the top guide sheave, extends downwards and wraps through a first bottom guide sheave of the bottom guide sheave and continues to extend to the traction sheave of the elevator machine room; after wrapping through the traction sheave, the rope then extends laterally and wraps through a second bottom guide sheave in the bottom guide sheave, extends upwards and wraps through a second top guide sheave of the top guide sheave, and continues to extend downwards to the counterweight.

In accordance with an additional or alternative embodiment, the number of the first top guide sheaves is two and they are arranged laterally on the jumping platform, the number of the first bottom guide sheaves/the second bottom guide sheaves is two and they are arranged substantially laterally.

In accordance with an additional or alternative embodiment, a first end of the rope is secured at the top of the elevator car, the rope extends upwards from the first end, wraps through a first top guide sheave of the top guide sheave, extends downwards and wraps through a first bottom guide sheave of the bottom guide sheave, and continues to extend to the traction sheave in the elevator machine room; after wrapping through the traction sheave, the rope then extends laterally and wraps through a second bottom guide sheave of the bottom guide sheave, extends upwards and wraps through a second top guide sheave of the top guide sheave, and continues to extend downwards to the counterweight.

In accordance with an additional or alternative embodiment, the jumping platform comprises a second upright and a cable-stayed member, wherein the second upright is removably positioned and mounted relative to a landing, an end of the jumping platform proximate to a lower end of the second upright is removably mounted on the landing, two ends of the cable-stayed member are pivotally connected to the upper end of the second upright and the jumping platform respectively.

In accordance with an additional or alternative embodiment, a fixing member is provided corresponding to the elevator car for fixing the elevator car to the guide rail during lifting of the jumping platform.

In accordance with an additional or alternative embodiment, the lifting assembly comprises: a suspension beam; a hoist detachably installed on the jumping platform or the elevator car; a diverting pulley mounted on the suspension beam; and a hoisting member extending from the hoist, wrapping through the diverting pulley, and extending onto the jumping platform or the elevator car.

In accordance with an additional or alternative embodiment, the hoist is a cable climber.

In accordance with an additional or alternative embodiment, the temporary working platform is positioned and mounted on a respective landing.

In accordance with an additional or alternative embodiment, rope compensation is provided from a first end of the rope during lifting of the elevator car.

In accordance with an additional or alternative embodiment, the traction ratio of the jumping elevator system is 2:1 or 1:1.

The above features, operations and advantages of the present invention will become more obvious from the following descriptions and drawings.

BRIEF DESCRIPTION OF THE DRAWINGS

The above and other objects and advantages of the present invention will become clearer and more complete from the following detailed descriptions given in conjunction with the drawings, wherein the same or similar elements are denoted by the same reference sign.

DETAILED DESCRIPTION OF THE EMBODIMENTS OF THE INVENTION

The present invention is described more fully hereinafter by reference to the accompanying drawings, in which illustrative embodiments of the invention are illustrated. The invention can, however, be realized in different embodiments and should not be construed as limited to the various embodiments set forth herein. The above-described embodiments are presented in order to provide a thorough and complete disclosure herein and thus achieve a more complete and accurate understanding of the protection scope of the present invention.

Terms such as "comprising" and "including" mean that subject matter of present invention does not exclude cases where there are other components not directly or explicitly recited, in addition to having components that are directly and explicitly recited in specification and claims.

In the following depiction, when it is alleged that a component is "fixed/secured" to another component, it may be directly fixed/secured to another component or may be indirectly fixed/secured to another component through an intermediate component. On the contrary, when it is alleged that a component is "directly fixed/secured" to another component, an intermediate component does not exist.

In the following depiction, the direction corresponding to "up-down direction" corresponds to the direction of the hoist, the direction corresponding to "left-right direction" or "lateral direction" is a direction approximately directing from a landing toward interior of the hoistway. It is to be understood that these directional terms are relative concepts, which are used to describe and clarify a relative position.

Figure 1:
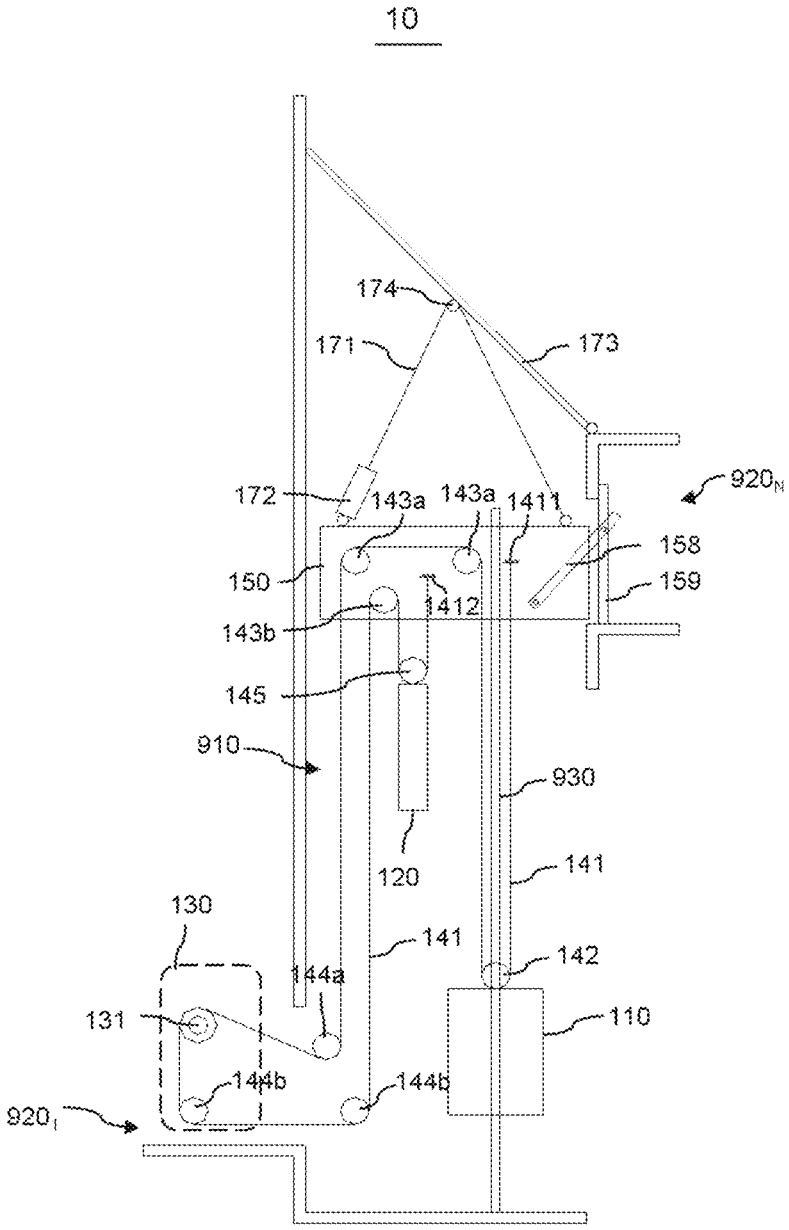
FIG. 1 is a structural schematic of a jumping elevator system according to an embodiment of the present invention.

FIG. 1 shows a structural schematic of a jumping elevator system in accordance with an embodiment of the present invention; FIG. 4 to FIG. 9 illustrate a jumping process of the jumping elevator system of the embodiment shown in FIG. 1 based on the jumping method of the embodiment shown in FIG. 3. The jumping elevator system illustrated in FIG. 1 and its jumping principle are described below in connection with FIGS. 1, 4-9.

As shown in FIG. 1, a jumping elevator system 10 can be used during construction process of a building, for example, materials and/or workers can be conveyed by an elevator car 110. The hoistway 910 corresponds to a hoistway of a building in a construction process; as the construction process advances, the height of an well-built hoistway 910 as shown in FIG. 1 will continue to increase, which requires the jump elevator system 10 to perform a jumping operation (or referred to as a climbing operation) in order to enable the jump elevator system 10 to serve a higher landing. FIG. 1 has shown a part of the well-built landings 920, e.g., landing $\mathbf{920}_1$, . . . , landing $\mathbf{920}_N$, landing $\mathbf{920}_{N+1}$, landing $\mathbf{920}_{N+2}$, etc.; it will be understood that the subscript of sign 920 corresponds to floor number at which the landing is located, and the particular number of floors of a building is not limiting.

Figure 5:
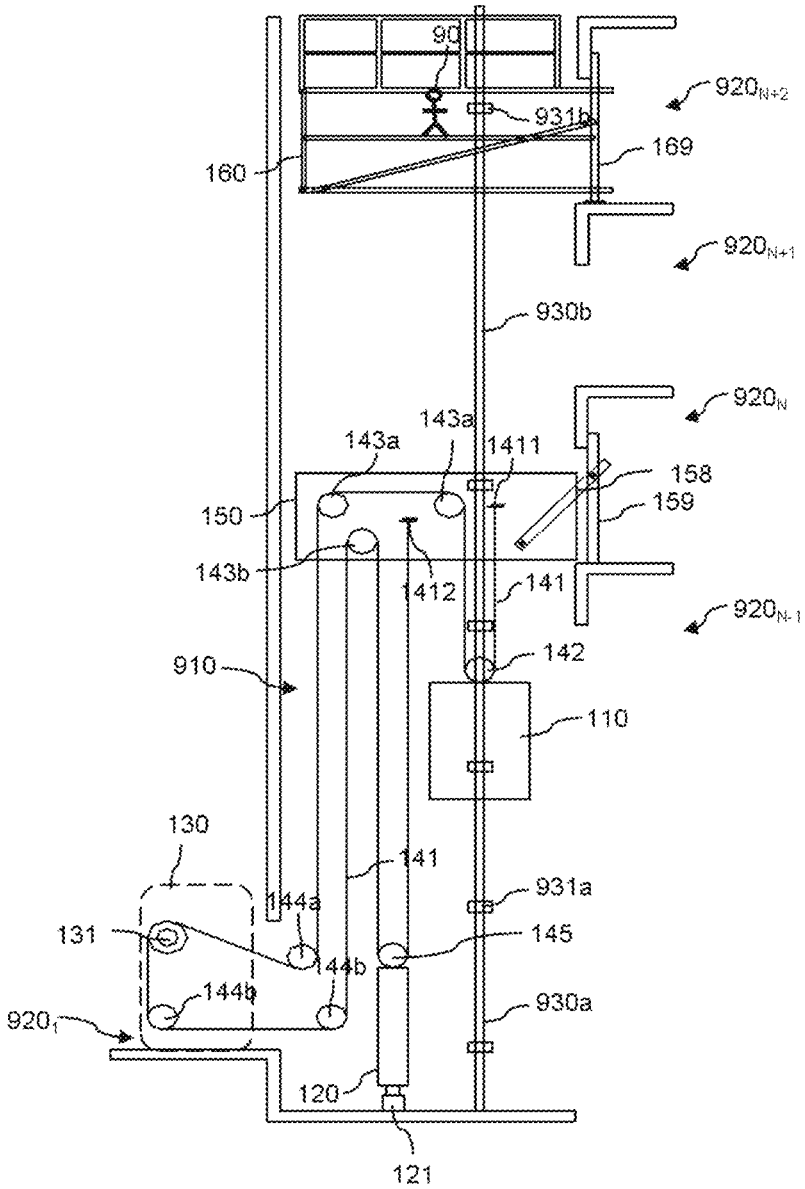

With reference to FIGS. 1 and 5, the jumping elevator system 10 can include the elevator car 110, a counterweight 120 disposed in the hoistway 910, an elevator machine room 130, a jumping platform 150, a lifting assembly, and a temporary working platform 160 (as shown in FIG. 5), optionally further includes a pulley assembly, etc. Therein, by means of the lifting assembly, the jumping platform 150 can jump as the height or level of the well-built hoistway 910 of the building increases.

Wherein the elevator machine room 130 is independently arranged relative to the jumping platform 150 and does not jump along with the jumping platform 150. The elevator machine room 130 can be provided with a tractor (not shown in the figures) and a traction sheave 131, and can also be provided with electrical equipment such as a control cabinet. In consideration that the elevator machine room 130 has a critical environmental requirement but it is difficult to provide a safe and dry environment (e.g., the bottom of the hoistway 910 prone to water accumulation, etc.) for the hoistway 910 of a building not constructed well, the elevator machine room 130 is moved outside of the hoistway 910 in embodiments of the present invention, for example, the elevator machine room 130 is fixed to the landing 920 outside of the hoistway 910; thus the elevator machine room 130 also does not need to be lifted by the lifting assembly or the like and also does not jump along with the jumping platform 150. The floor number of the landing 920 to which the elevator machine room 130 is fixed is not limiting, and the elevator machine room 130 may, but is not limited to, be fixedly disposed on the landing $\mathbf{920}_1$, e.g., may also be fixed on other landing 920 as desired.

The elevator machine room 130 may be fixedly mounted as a temporary elevator machine room on, for example, the landing $\mathbf{920}_1$; in an embodiment, the temporary elevator machine room can be removed, and then be transferred and installed to a predetermined location in the hoistway 910 (e.g., the top of the hoistway 910) for installation after completing the construction of the building, so as to transform the jumping elevator system 10 of the embodiment of the invention into a conventional elevator system normally used in an well-built building, which can realize the recycling of components (such as a tractor and the like) of the elevator machine room 130, and the cost is greatly reduced for a constructor of the building; moreover, it is also very convenient for operations of transferring and installing the elevator machine room 130 on the landing 920. The elevator machine room 130 can be selectively disposed adjacent to the hoistway 910, which will reduce the difficulty of arranging the pulley assembly of the following embodiments and also facilitate reducing traction power requirement on the tractor.

Therein, the elevator car 110 can travel up and down along the guide rail 930 in the well-built hoistway 910 of the building under a traction, for example, of the traction sheave 131. It should be noted that the guide rail 930 is a basic component for supporting the elevator car 110 to travel in the hoistway 910; thus, if it is desired that the elevator car 110 could travel to certain height, such as landing $\mathbf{920}_{N+1}$, the guide rail 930 in the hoistway 910 should be positioned and mounted to at least landing $\mathbf{920}_{N+1}$ or above the landing $\mathbf{920}_{N+1}$. FIGS. 4-9 also illustrate a positioning and mounting process of the guide rail 930 in the hoistway 910, where 930*a* denotes an well-mounted guide rail, and 930*b* denotes a guide rail to be mounted. In an embodiment, the mounting of the guide rail 930 may be reinforced sectionally (e.g., secured to a wall of the hoistway 910) on the hoistway 910 using a plurality of guide rail brackets 931, where 931*a* denotes the guide rail bracket applied on the well-mounted guide rail 930*a*, and 931*b* denotes the guide rail bracket applied on the guide rail 930*b* to be mounted correspondingly.

With continued reference to FIG. 1, the pulley assembly can transmit traction from the traction sheave 131 to the elevator car 110 or counterweight 120, which may include a rope 141, one or more top guide sheaves 143, and one or more bottom guide sheaves 144.

The rope 141 may be various types of traction member (e.g., banded rope) adaptable for elevator systems, whose cross-sectional shape may be generally circular, square, etc., and the materials used of which are not limiting. The rope 141 has two ends, i.e., a first end 1411 and a second end 1412, which are both secured to the jumping platform 150 (e.g., secured to a spandrel girder of the jumping platform 150) in the embodiment shown in FIG. 1 so that it can jump along with the jumping platform 150.

With continued reference to FIG. 1, one or more top guide sheaves 143 are disposed on the jumping platform 150 and capable of jumping along with the jumping platform 150, and the bottom guide sheaves 144 are disposed corresponding to the elevator machine room 130, which can be partially disposed in the hoistway 910, or can be partially disposed outside of the hoistway 910 (e.g., even the bottom guide sheave 144*b* is disposed in the elevator machine room 130). The top guide sheaves 143 and the bottom guide sheaves 144 are arranged to guide the rope 141 to extend at least from the hoistway 910 to the traction sheave 131 in the elevator machine room 130 outside of the hoistway 910, such that the elevator machine room 130 can be fixed to a certain landing 920 outside of the hoistway 910, without limitation of fixing in the hoistway 910, improving the flexibility of the arrangement of the elevator machine room 130, and conveniently introducing traction from the traction sheave 131 outside of hoistway 910 to equipment in hoistway 910 (e.g. elevator car 110 or counterweight 120).

In an embodiment, the arrangement of the top guide sheaves 143 and the bottom guide sheaves 144 as well as the winding of the rope 141 can be selected to achieve a traction ratio (or referred to as a suspension ratio) of 2:1, for example, a roof pulley 142 can also be provided at the top of the elevator car 110 and a diverting sheave 145 can be provided at the top of the counterweight 120; the top guide sheaves 143 and the bottom guide sheaves 144 are further arranged to guide the rope 141 to extend at least from the roof pulley 142 toward the traction sheave 131 in the elevator machine room 130 outside of the hoistway 910 such that the tractor can transmit a traction force to the top of the elevator car 110 through the pulley assembly. In this way, it can achieve a traction ratio of 2:1 for lifting the elevator car 110 from the top of the elevator car 110.

Referring to FIG. 1, a specific arrangement of the pulley assembly is presented by way of example in detail. A rope 141 extends downward from the first end 1411, wraps through the roof pulley 142, extends upwards and wraps through the first top guide sheave 143*a* of the top guide sheave 143, extends downwards and wraps through the first bottom guide sheave 144*a* of the bottom guide sheave 144, and continues to extend to the traction sheave 131 of the elevator machine room 130; after wrapping through the traction sheave 131, the rope the rope 141 extends laterally and wraps through the second bottom guide sheave 144*b* of the bottom guide sheave 144, extends upwards and wraps through the second top guide sheave 143*b* of the top guide sheave 143, and continues to extend downwards to the diverting sheave 145 at the top of the counterweight 120, and finally extends upwards and is secured at the second end 1412.

In an embodiment, there may be two first top guide sheaves 143*a* and they are arranged laterally on the jumping platform 150, thereby guiding the rope 141 in a left-right direction to guide in a direction toward the elevator machine room 130; the first bottom guide sheave 144*a* may be one and it can be disposed in the hoistway 910 and proximate to the elevator machine room 130; the second bottom guide sheaves 144*b* may be two and arranged approximately laterally, one of which may be disposed in the elevator machine room 130 and the other which is disposed in the hoistway 910, thereby guiding the rope 141 in a left-right direction to guide in a direction toward the hoistway 910.

Figure 2:
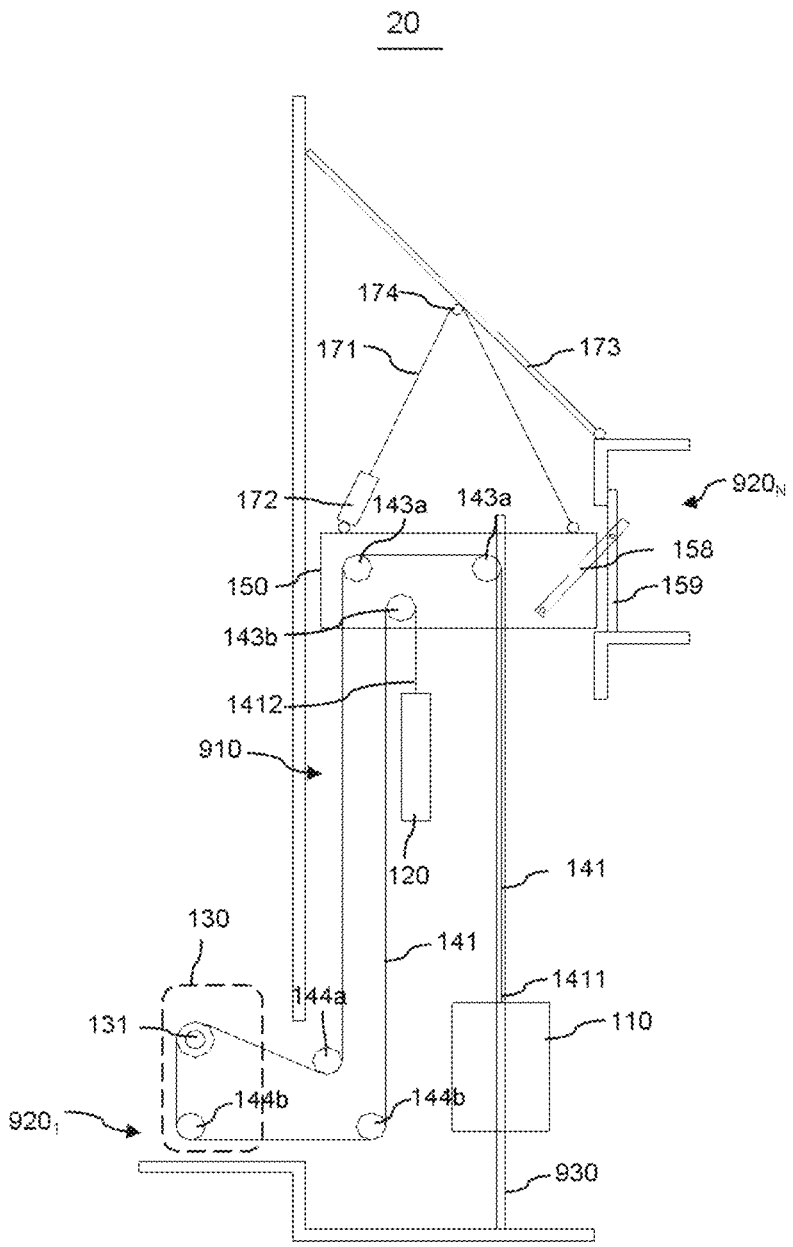
FIG. 2 is a structural schematic of a jumping elevator system according to another embodiment of the present invention.

It should be noted that the pulley assembly may achieve the traction ratio of 2:1 in other arrangements. By way of example, the diverting sheave 145 may also be not provided on the counterweight 120 of FIG. 1, as shown in FIG. 2, with the second end 1412 of the rope 141 secured to the counterweight 120, such that an arrangement of the elevator car with a roof pulley and the counterweight without a sheave is achieved.

Still referring to FIG. 1, the jumping platform 150 may be removably fixed at a landing (e.g., landing $\mathbf{920}_N$); when the jumping operation is not needed, the jumping platform 150 is fixed at the landing $\mathbf{920}_N$, thereby providing suspension support for the elevator car 110, the counterweight 120 and the like; when the jumping operation is needed, its fixation relative to the landing $\mathbf{920}_N$ is dismounted, thereby preparing for jumping to other landing.

In an embodiment, the jumping platform 150 includes a second upright 159 and a cable-stayed member 158, and the second upright 159 and the cable-stayed member 158 are deposed for conveniently and removably fixing the jumping platform 150 at certain landing; wherein the second upright 159 is removably positioned and mounted relative to the landing $\mathbf{920}_N$ (e.g., stuck at a landing door gate of the landing $\mathbf{920}_N$ in up and down direction), the end of jumping platform 150, close to the lower end of second upright 159, is removably mounted on the landing $\mathbf{920}_N$ (e.g., projected to the floor of the landing $\mathbf{920}_N$ by a retractable member, thereby simply lapping the landing $\mathbf{920}_N$); and two ends of the cable-stayed member 158 are pivotably connected to the upper end of the second upright 159 and the jumping platform 150 respectively; therefore, the cable-stayed member 158, the second upright 159 and the right end part of the jumping platform 150 can construct a relatively stable structure with right triangle, and the jumping platform 150 is fixedly mounted in the hoistway 910 corresponding to the landing $\mathbf{920}_N$. When the jumping platform 150 needs to be removed, the second upright 159 can be dismounted from the landing $\mathbf{920}_N$, and the second upright 159 and the cable-stayed member 158 can be rotated and placed on the jumping platform 150, ready for removing the jumping platform 150. After the jumping platform 150 jumps to the next landing (e.g., landing $\mathbf{920}_{N+2}$), the second upright 159 is pulled out and positioned and mounted at the landing $\mathbf{920}_{N+2}$, so that its operation is very convenient.

It is to be noted that, since no elevator machine room is provided on the jumping platform 150, the jumping platform 150 can be implemented in a relatively simple structure and is lightweight, for example, the jumping platform 150 can be implemented in a simple spandrel girder frame or the like and occupies a small hoistway space in the up-down direction; moreover, the jumping platform 150 also thus can be implemented at low cost even though the jumping platform 150 did not be transformed to a component of the conventional elevator system after the building construction is completed, the cost is low for the constructor of the building. In addition, the jumping platform 150 can be reused in a different jumping elevator system for manufacturers of jumping elevator.

Still referring to FIG. 1, the lifting assembly in an embodiment includes a hoisting member 171, a hoist 172, a suspension beam 173, and a diverting pulley 174 mounted on the suspension beam 173. The lifting assembly may be configured to lift the jumping platform 150 to a higher height when the height of the hoistway 910 is increased, and further lifting the elevator car 110 after lifting the jumping platform 150 so as to extend its traveling distance in the hoistway 910. It is to be noted that rope compensation may be provided from, for example, the first end 1411 when lifting the elevator car 110, specifically a rope compensating component (not shown in figures) cab be provided at a location corresponding to the first end 1411.

Due to the fact that the jumping platform 150 is lightweight (because the elevator machine room is not provided on the jumping platform 150) and the jumping platform 150 and the elevator car 110 are lifted separately, the lifting power requirement for the lifting assembly is greatly reduced, which favors to simplify the structural design of the lifting assembly and saving the construction cost of a building.

It will be appreciated that, prior to lifting the elevator car 110, the lifting assembly may be reloaded on the elevator car 110 from the jumping platform 150; specifically, the hoist 172 is removably mounted on the jumping platform 150 or the elevator car 110, and the hoisting member 171 (e.g., a rope) may extend from the hoist 172, wrap though the diverting pulley 174, and extend onto the jumping platform 150 or the elevator car 110; in such, it is easy to reload the hoist 172 and the hoisting member 171 between the jumping platform 150 and the elevator car 110. Specifically, one end of the suspension beam 173 can be hinged and fixed to the landing $\mathbf{920}_N$, the other end of the suspension beam 173 is in lap joint with the hoistway 910, thereby the dismounting of the lifting assembly relative to the landing 920 is easy, and the workload of the jumping operation is reduced.

In view that the power requirement on the hoist 172 are greatly reduced, the hoist 172 can be selectively implemented by a cable climber, which is low in cost and small in volume.

It should be noted that a fixing member (e.g., suspension, safety clamp, etc.) may be provided on the corresponding elevator car 110. The elevator car 110 can be fixed to the guide rail 930 by the fixing member during lifting of the jumping platform 150, thus free lifting of the jumping platform 150 is unaffected from the elevator car 110.

Referring to FIG. 5, the jumping elevator system 10 also includes a temporary working platform 160 used in the jumping process. The temporary working platform 160 can be independently arranged relative to the jumping platform 150, and the temporary working platform 160 is provided for preliminarily positioning and mounting the guide rail 930*b* to be reinforced, jointed at a second height (e.g., the landing $\mathbf{920}_N$), relative to the hoistway 910 prior to lifting the jumping platform 150 from the second height (e.g., landing $\mathbf{920}_N$); specifically, the temporary working platform 160 is positioned and installed on the landing $920_{N+2}$ and placed in the hoistway 910, thereby providing a worker 90 with a working platform in the hoistway 910; the worker 90 can conveniently mount the guide rail bracket 931*b* on the wall of the hoistway 910, so that the guide rail 930*b* to be mounted is primarily positioned and mounted relative to the hoistway 910.

In an embodiment, the temporary working platform 160 is positioned and mounted on a landing 920 (e.g., landing $920_{N+2}$) corresponding to a first height by a first uprights 169. After completing the work of preliminary positioning and installing for the guide rail 930*b*, the temporary working platform 160 can be removed from the landing $920_{N+2}$ and continue to be applied during the next jumping operation. The temporary working platform 160 can be realized by a simple steel structure frame, is low in manufacturing cost and can be shared by a plurality of jumping elevator systems 10 in a plurality of hoistways 910, so that the construction cost of a building can be reduced. Also, in conjunction with the following example illustration of the jumping method, it will be appreciated that the temporary working platform 160 will be highly advantageous to avoid the use of scaffolding in the hoistway 910 to position and mount a newly extending rail 930*b*.

FIG. 2 shows a structural schematic of a jumping elevator system in accordance with another embodiment of the present invention. Compared to the embodiment of jumping elevator system 10 shown in FIG. 1, the jumping elevator system 20 has the main difference lying in that the arrangement of the pulley assembly thereof is different so as to achieve different traction ratio, and the traction ratio of the jumping elevator system 20 is 1:1.

Referring to FIG. 2, the top of the elevator car 110 is not provided with a roof pulley, nor is the top of the counterweight 120 provided with a diverting sheave, and the first end 1411 of the rope 141 is secured to the top of the elevator car 110, the rope 141 extends upwards from the first end 1411 and wraps through the one or more first top guide sheaves 143*a*, extends downwards and wraps through the first bottom guide sheave 144*a*, and continues to extend to the traction sheave 131 of the elevator machine room 130; after wrapping through the traction sheave 131, the rope 141 then extends laterally and wraps through one or more second bottom guide sheaves 144*b*, extends upwards and wraps through a second top guide sheave 143*b* of the top guide sheave 143, and continues downwards to the counterweight 120. In this way a traction ratio of 1:1 of the jumping elevator system 20 can be specifically achieved.

In other embodiment, the top diverting sheave 145 as shown in FIG. 1 can also be provided on the counterweight 120 in FIG. 2, through which the rope 141 wraps and extends upwards to the second end 1412, such that an arrangement of the elevator car without a roof pulley and the counterweight with a sheave is achieved.

Based on the above teachings of the arrangements of pulley assemblies of FIGS. 1 and 2, it will be appreciated that pulley assembly arrangements corresponding to other traction ratios may also be applied in the present invention.

Figure 3:
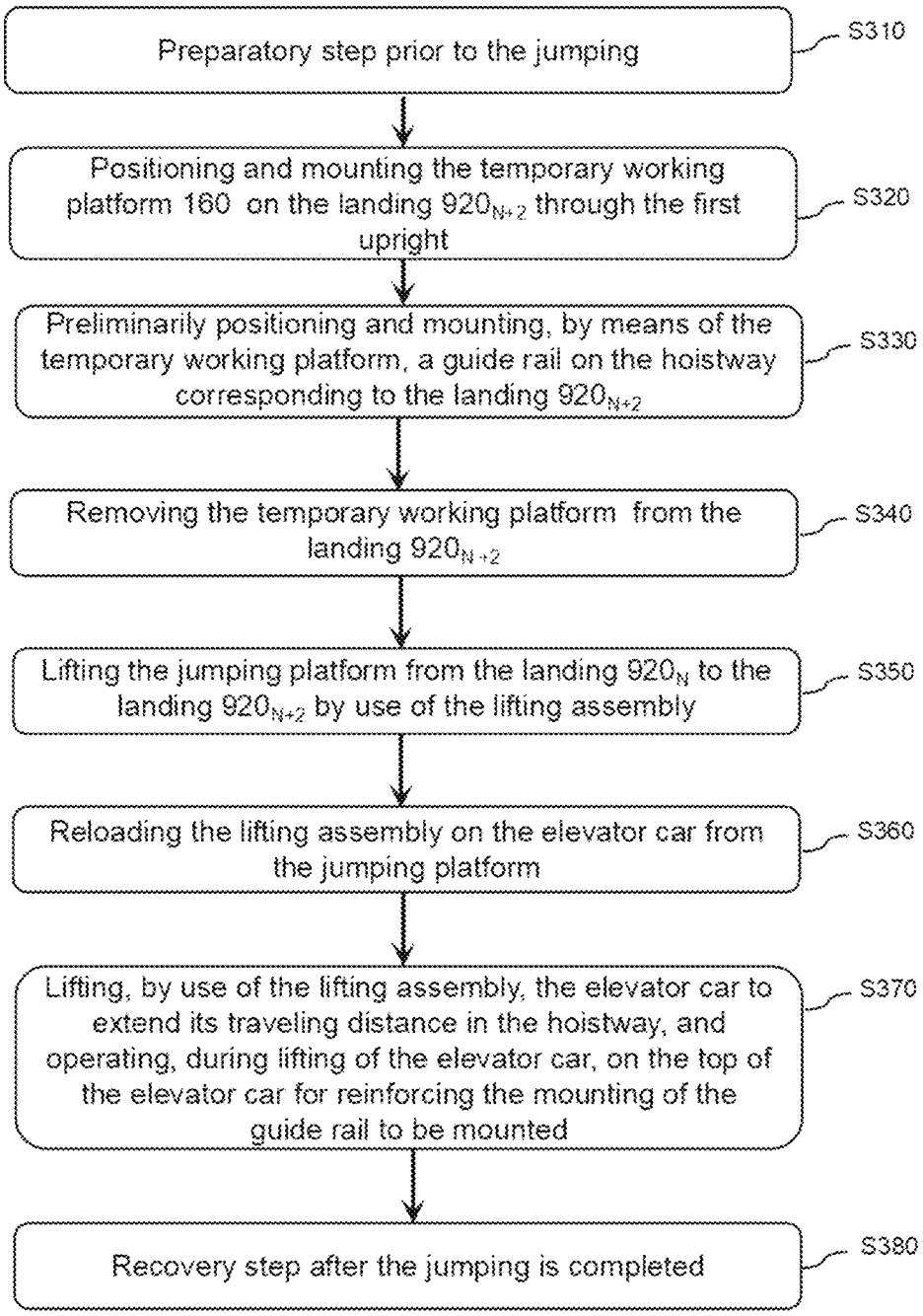
FIG. 3 is a flowchart of a jumping method of a jumping elevator system according to an embodiment of the present invention.
Figure 4:
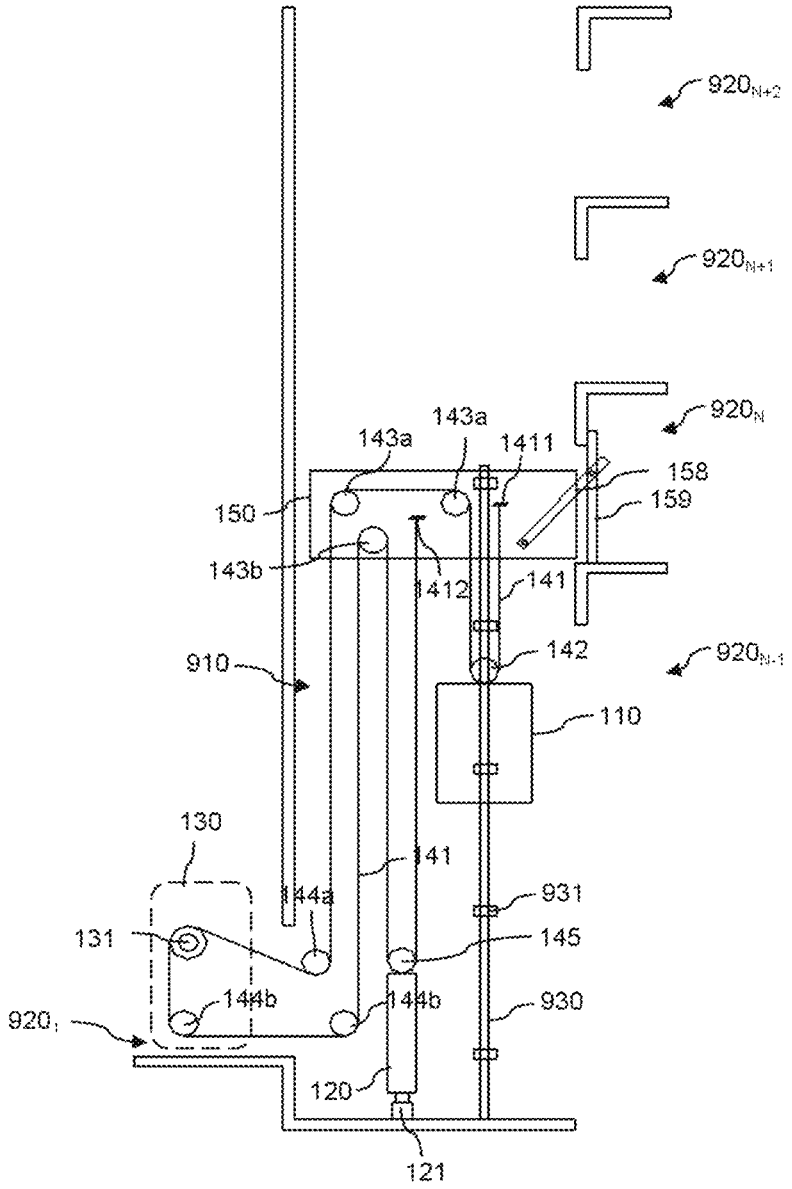
FIG. 4 to FIG. 9 illustrate a jumping process of the jumping elevator system of the embodiment shown in FIG. 1 based on the jumping method of the embodiment shown in FIG. 3.
Figure 6:
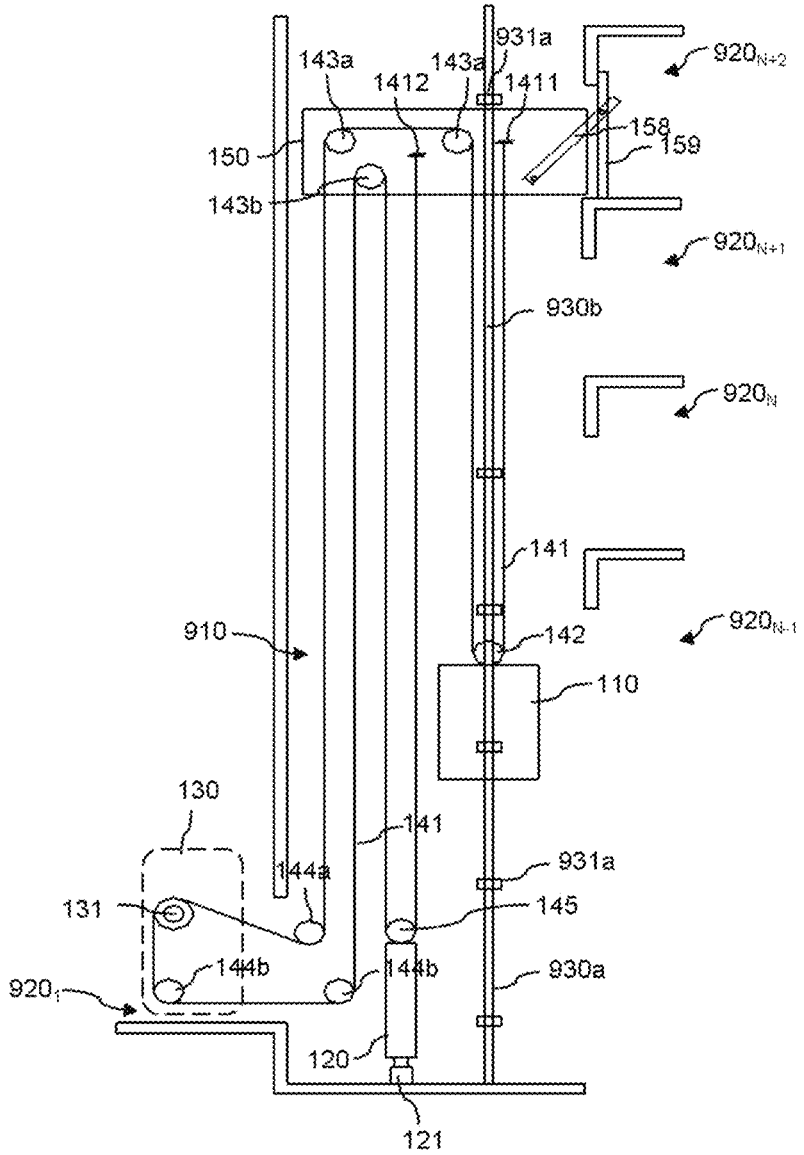
Figure 7:
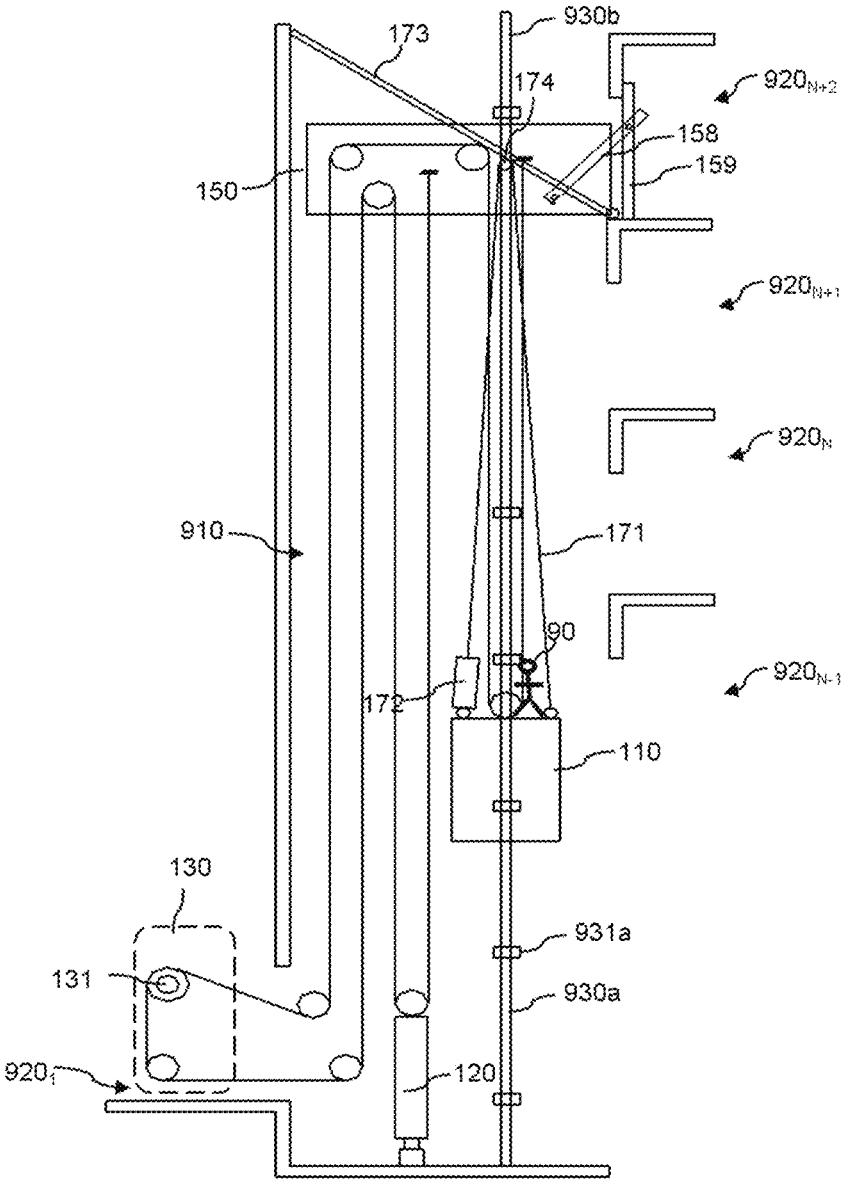
Figure 8:
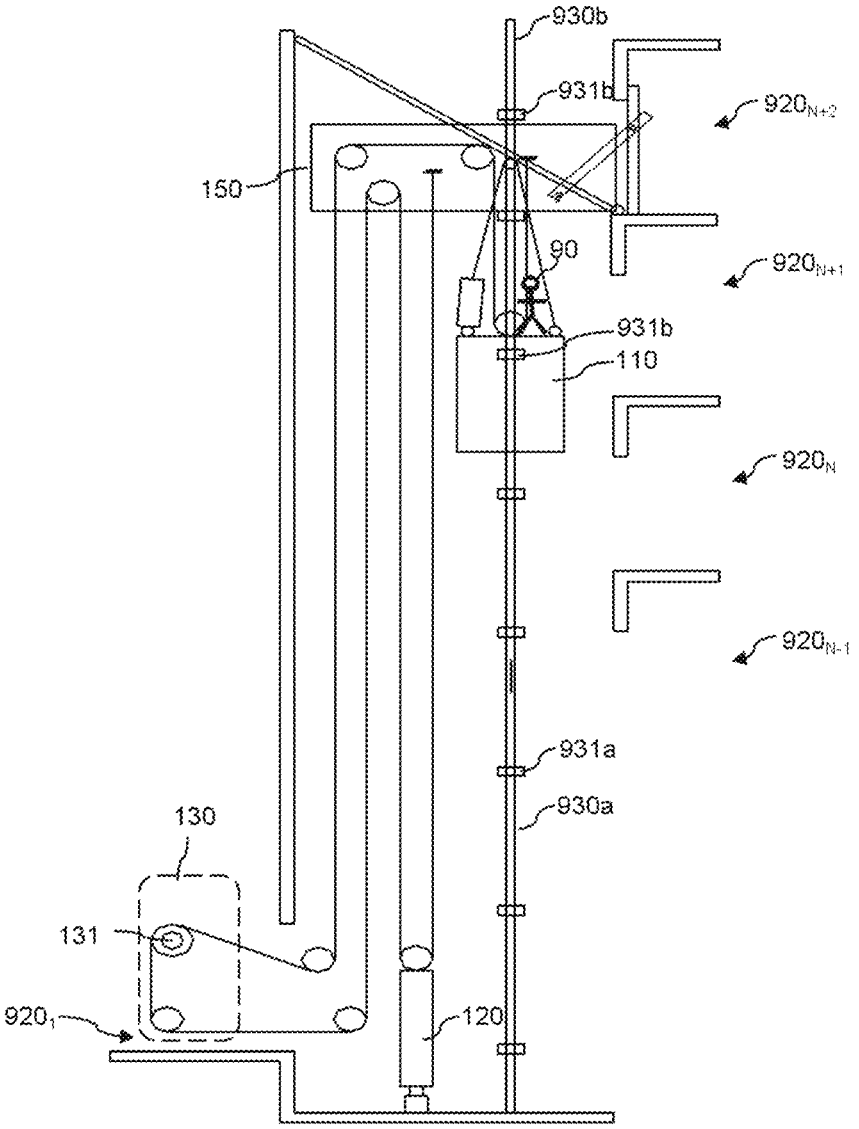
Figure 9:
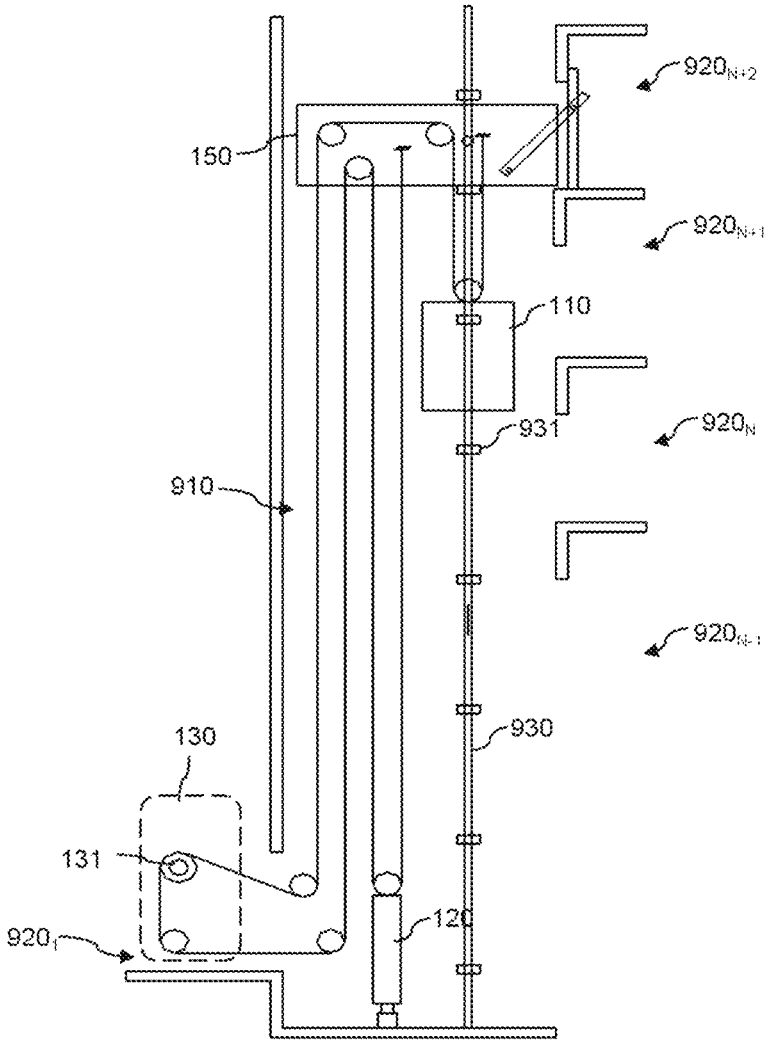

FIG. 3 shows a flowchart of a method of jumping a jumping elevator system according to an embodiment of the present invention; FIG. 4 to FIG. 9 illustrate a jumping process of the jumping elevator system of the embodiment shown in FIG. 1 based on the jumping method of the embodiment shown in FIG. 3, wherein, FIG. 4 illustrates the jumping elevator system preparing for jumping from the landing $920_N$, FIG. 5 illustrates installing the temporary working platform from the landing $920_{N+2}$ for preliminarily positioning and mounting guide rails in the hoistway, FIG. 6 illustrates the use of the lifting assembly to lift the jumping platform from the landing $920_N$ to approximately the landing $920_{N+2}$, FIG. 7 illustrates lifting the elevator car progressively starting from the landing $920_{N-1}$ by use of the lifting assembly and positioning and mounting the guide rails segment by segment on the top of the elevator car, FIG. 8 illustrates that the elevator car is lifted to the landing $920_{N+1}$ by use of the lifting assembly and all guide rails are positioned and mounted well segment by segment on the top of the elevator car, and FIG. 9 illustrates that the jumping elevator system completes a jumping operation and is ready to regain entering normal elevator operation. The operating principle of the jumping elevator system of the embodiment shown in FIG. 1 and an embodiment of jumping method of the invention are illustrated by example below in connection with FIGS. 3-9.

Firstly, in step S310, referring to FIG. 4, preparatory works are completed prior to the jumping, which specially includes securing the elevator car 110 to an mounted guide rail 930*a* below the second height (e.g., a height corresponding to the landing $920_N$) by securing members such as safety clamps, suspensions, etc., securing the counterweight 120 in the hoistway 910 (e.g., securing the counterweight 120 in the bottom of the hoistway 910 by securing portion 121);

In step S320, the temporary working platform 160 is positioned and mounted on a landing (e.g., landing $920_{N+2}$) corresponding to the first height via the first upright 169, such that the worker 90 can conveniently enter from the landing $920_{N+2}$ onto the temporary working platform 160 and operate in the hoistway 910.

In step S330, referring to FIG. 5, the guide rail 930*b* to be mounted, jointed at the second height, is preliminary positioned and mounted in the hoistway 910 corresponding to approximately the first height (e.g., in the hoistway corresponding to the landing $920_{N+2}$) by means of the temporary working platform 160, for instance, the guide rail 930*b* hoisted into the hoistway 910 is fastened relative to the hoistway 910 at the first height with the guide rail bracket 931*b*. It will be understood that, in consideration of safety requirements, the guide rail 930*b* with such preliminary positioning and mounting conditions is not suitable for guiding the elevator car 110 to travel thereon.

In step S340, the temporary working platform 160 is removed from the landing $920_{N+2}$, that is, removing the temporary working platform 160 from a position of the hoistway 910 corresponding to the first height, thereby unaffecting subsequent lifting operations.

In step S350, referring to FIG. 6, the jumping platform 150 is lifted from the landing $920_N$ to the landing $920_{N+2}$ by use of the lifting assembly; as desired, in other embodiment, it is also possible to lift the jumping platform 150 from the landing $920_N$ to the landing $920_{N+1}$; that is say, in this step, the lifting assembly may be used to lift the jumping platform 150 from the second height to a third height, wherein the third height is greater than the second height and less than or equal to the first height. In this step, since the jumping platform 150 is lightweight and no worker 90 is standing on it, it can be done relatively quickly.

In step S360, referring to FIG. 7, the lifting assembly is reloaded on the elevator car 110 from the jumping platform 150, specifically, the hoist 172 and the hoisting member 171 may be removed from the jumping platform 150 firstly and then mounted respectively on the top of the elevator car 110, thereby preparing for performing a lifting operation on the elevator car 110.

In step S370, referring to FIGS. 7 and 8, the elevator car 110 is lifted by use of the lifting assembly to extend its traveling distance in the hoistway 910, and operations is performed on the top of the elevator car 110 during lifting of the elevator car 110 for sectionally reinforcing the mounting of the guide rails 930*b* to be mounted. It will be appreciated that, prior to lifting the elevator car 110, the fixation of the elevator car 110 relative to the guide rail 930*a* can be released. It will be appreciated that, in the process of lifting the elevator car 110 by the lifting assembly, the lifting assembly and the elevator car 110 together provide the worker 90 with a working platform for reinforcing the mounting of the guide rail 930*b*; the reinforcement of mounting may specifically refer to mounting the guide rail 930*b* to the wall of the hoistway 910 with a plurality of guide rail brackets 931.

In step S370, the worker 90 can stand on top of the elevator car 110 for performing mounting operation of such as the guide rail bracket 931, and the hoisting member 171 of the lifting assembly and the rope 141 of the pulley assembly can provide a good safety guarantee for the lifting process of the elevator car 110; the mounting of guide rail 930*b* is reinforced sectionally during progressive lifting of the elevator car 110, thereby providing guide rail segments with enough safety for the elevator car 110 in the subsequent lifting process. By way of example, through this step S370, not only is the guide rails 930*b* below the landing $\mathbf{920}_{N+2}$ positioned and mounted well, the elevator car 110 is also lifted relative to the counterweight 120, for example, lifted to the landing $\mathbf{920}_{N+1}$.

It should be noted that the "lifting process of the elevator car 110" in this step S370 can include multiple sub-processes of sectionally lifting the elevator car 110, and the lifting of the elevator car 110 and the operation of reinforcing the mounting of the guide rail 930 can be performed at the same time. In an embodiment, after each of the guide rail 930*b* is reinforced well by the worker 90 on the elevator car 110, the lifting assembly may be controlled to lift the elevator car 110 with a distance along the well-reinforced guide rail 930*b*.

In step S380, referring to FIG. 9, it is the recovery step after the jumping is completed, which mainly includes the worker 90 coming out of the hoistway 910, removing the lifting assembly from the landing, releasing the fixation of the counterweight 120, and the like; elevator car 110 may thus travel between the landing $\mathbf{920}_1$ and the landing $\mathbf{920}_{N+1}$ under the drive of the tractor.

Thereto, the jumping process of the jumping elevator system 10 is substantially completed. It will be understood that the above jumping process can be repeated, and the embodiment of the jumping elevator system 20 shown in FIG. 2 can also complete a similar jumping process.

The jumping method of the above embodiment especially have one or more of the following advantages:

(1) Scaffolding in the hoistway 910 for positioning and mounting the guide rails 930*b* is not required during the entire jumping process, so that the jumping operation becomes simple, efficient and low-cost;

(2) the worker 90 can perform operation of reinforcing the mounting of the guide rail 930*b* on the top of the elevator car 110, so that the mounting of the guide rail can be reinforced sectionally while the elevator car 110 is progressively lifted relative to the counterweight 120, and the safety of the worker 90 is good;

(3) the same lifting assembly can be used for separately completing lifting operations for the jumping platform 150 and the elevator car 110, and the lifting assembly can be realized at low cost;

(4) for the well-built hoistway 910, the height at which the jumping platform 150 and the elevator car 110 are able to jump is high, for instance, the jumping platform 150 can jump even to the highest landing of the hoistway 910 and the elevator car 110 can jump even to the second-highest landing of the hoistway 910.

It will be appreciated, in connection with the above jumping methods, that embodiment of the jumping elevator system of the present invention have one or more of the following advantages:

(a) the jumping platform 150 and the elevator car 110 can be separately jumped, so that the worker 90 can safely perform operations of positioning and mounting the guide rail 930*b* at the top of the elevator car 110, thus the mounting of guide rail can be reinforced sectionally while the elevator car 110 is progressively lifted relative to the counterweight 120, and there is no need to use scaffolding in the hoistway 910 for positioning and mounting rails 930*b* in cooperate with the use of the temporary working platform 160;

(b) the elevator machine room 130 can be flexibly arranged on the outside of the hoistway 910, and its temporary mounting and dismounting are convenient, and it can avoid severe environments (such as severe environments in extreme weather) in hoistway 910 not constructed well, thereby guaranteeing the reliability and safety of the elevator machine room 130;

(c) the lifting assembly, the jumping platform 150 and the like can be realized at low cost, so that the cost of the jumping elevator system 10 can be greatly reduced;

(d) for the well-built hoistway 910, the height at which the jumping platform 150 and the elevator car 110 are able to jump is high, for instance, the jumping platform 150 can jump even to the highest landing of the hoistway 910 and the elevator car 110 can jump even to the second-highest landing of the hoistway 910; moreover, since no elevator machine room is provided in the pit of the hoistway 910, the elevator car 110 can travel to the lowest landing of the hoistway, thus during construction process of a building, the range of travel-able landings for the elevator car 110 is large, and the conveying of workers and/or materials can be achieved between more landings.

The above examples mainly illustrate the embodiments of the jumping elevator system and the jumping method of the present invention. Although only some of the embodiments of the present invention have been described, those ordinarily skilled in the art shall understand that that the present invention can be implemented in many other forms without departing from its principle and scope. Therefore, the examples and implementations described are regarded as illustrative rather than restrictive, and the present invention may cover various modifications and substitutions as long as they do not depart from the spirit and scope of the present invention as defined by the appended claims.

What is claimed is:

1. A jumping method of a jumping elevator system, comprising:

preliminarily positioning and mounting, by means of a temporary working platform at a first height, a guide rail on a hoistway substantially corresponding to the first height;

removing the temporary working platform from a position, corresponding to the first height, of the hoistway;

lifting, by use of a lifting assembly, a jumping platform from a second height to a third height, wherein the third height is greater than the second height and less than or equal to the first height;

lifting, by use of the lifting assembly, an elevator car to extend its traveling distance in the hoistway;

reloading, prior to lifting the elevator car, the lifting assembly on the elevator car from the jumping platform.

2. The jumping method of claim 1, further comprising:

positioning and mounting, prior to the preliminarily positioning and mounting of the guide rail, the temporary working platform on a landing corresponding to the first height by a first upright.

3. The jumping method of claim 1, further comprising:

fixing, prior to lifting the jumping platform, the elevator car to the guide rail below the second height; and releasing, prior to lifting the elevator car, the fixation of the elevator car relative to the guide rail.

4. The jumping method of claim 1, further comprising:

fixing, prior to lifting the jumping platform, a counterweight in the hoistway; and releasing the fixation of the counterweight after lifting the elevator car.

5. A jumping elevator system used in a construction process of a building, including:

an elevator car capable of traveling up and down along a guide rail in a hoistway of the building;

a counterweight disposed in the hoistway;

a jumping platform capable of jumping along with an increase of height of the hoistway;

an elevator machine room which is independently arranged relative to the jumping platform and is incapable of jumping along with the jumping platform;

a temporary working platform which is independently arranged relative to the jumping platform and is provided for preliminarily positioning and mounting the guide rail relative to the hoistway prior to lifting the jumping platform; and a lifting assembly for lifting the jumping platform to a higher height when the height of the hoistway is increased, reloading the lifting assembly on the elevator car from the jumping platform and further lifting the elevator car after lifting the jumping platform so as to extend its traveling distance in the hoistway;

wherein the elevator machine room is fixed on a landing outside of the hoistway;

the jumping elevator system further includes a pulley assembly which at least comprises a rope, a top guide sheave and a bottom guide sheave;

wherein the top guide sheave is arranged on the jumping platform and is capable of jumping along with the jumping platform, the top guide sheave and the bottom guide sheave are arranged to guide the rope to extend at least from the hoistway toward a traction sheave in the elevator machine room outside of the hoistway.

6. The jumping elevator system of claim 5, wherein the top guide sheave and the bottom guide sheave are further arranged to guide the rope to extend at least from a top of the elevator car in the hoistway toward the traction sheave in the elevator machine room outside of the hoistway such that a tractor can transmit a traction force to the top of the elevator car through the pulley assembly.

7. The jumping elevator system of claim 6, wherein a first end of the rope is secured at the top of the elevator car, the rope extends upwards from the first end, wraps through a first top guide sheave of the top guide sheave, extends downwards and wraps through a first bottom guide sheave of the bottom guide sheave, and continues to extend to the traction sheave in the elevator machine room; after wrapping through the traction sheave, the rope then extends laterally and wraps through a second bottom guide sheave of the bottom guide sheave, extends upwards and wraps through a second top guide sheave of the top guide sheave, and continues to extend downwards to the counterweight.

8. The jumping elevator system of claim 6, wherein the pulley assembly further comprises a roof pulley provided at the top of the elevator car;

the top guide sheave and the bottom guide sheave are further arranged to guide the rope to extend at least from the roof pulley toward the traction sheave in the elevator machine room outside of the hoistway such that the tractor can transmit a traction force to the top of the elevator car through the pulley assembly.

9. The jumping elevator system of claim 8, wherein a first end of the rope is secured to the jumping platform, the rope extends downwards from the first end, wraps through the roof pulley, extends upwards and wraps through a first top guide sheave of the top guide sheave, extends downwards and wraps through a first bottom guide sheave of the bottom guide sheave and continues to extend to the traction sheave in the elevator machine room; after wrapping through the traction sheave, the rope then extends laterally and wraps through a second bottom guide sheave of the bottom guide sheave, extends upwards and wraps through a second top guide sheave of the top guide sheave, and continues to extend downwards to the counterweight.

10. The jumping elevator system of claim 9, wherein the number of the first top guide sheaves is two and they are arranged laterally on the jumping platform, the number of the first bottom guide sheaves/the second bottom guide sheaves is two and they are arranged substantially laterally.

11. The jumping elevator system of claim 5, wherein a fixing member is provided corresponding to the elevator car for fixing the elevator car to the guide rail during lifting of the jumping platform.

12. The jumping elevator system of claim 5, wherein the temporary working platform is positioned and mounted on a respective landing.

13. The jumping elevator system of claim 5, wherein rope compensation is provided from a first end of the rope during lifting of the elevator car.

14. The jumping elevator system of claim 5, wherein the traction ratio of the jumping elevator system is 2:1 or 1:1.

15. A jumping elevator system used in a construction process of a building, including:

an elevator car capable of traveling up and down along a guide rail in a hoistway of the building;

a counterweight disposed in the hoistway;

a jumping platform capable of jumping along with an increase of height of the hoistway;

an elevator machine room which is independently arranged relative to the jumping platform and is incapable of jumping along with the jumping platform;

a temporary working platform which is independently arranged relative to the jumping platform and is provided for preliminarily positioning and mounting the guide rail relative to the hoistway prior to lifting the jumping platform; and a lifting assembly for lifting the jumping platform to a higher height when the height of the hoistway is increased, and further lifting the elevator car after lifting the jumping platform so as to extend its traveling distance in the hoistway;

wherein the jumping platform comprises a second upright and a cable-stayed member, wherein the second upright is removably positioned and mounted relative to a landing, an end of the jumping platform proximate to a lower end of the second upright is removably mounted on the landing, two ends of the cable-stayed member are pivotally connected to the upper end of the second upright and the jumping platform respectively.

16. A jumping elevator system used in a construction process of a building, including:

an elevator car capable of traveling up and down along a guide rail in a hoistway of the building;

a counterweight disposed in the hoistway;

a jumping platform capable of jumping along with an increase of height of the hoistway;

an elevator machine room which is independently arranged relative to the jumping platform and is incapable of jumping along with the jumping platform;

a temporary working platform which is independently arranged relative to the jumping platform and is provided for preliminarily positioning and mounting the guide rail relative to the hoistway prior to lifting the jumping platform; and a lifting assembly for lifting the jumping platform to a higher height when the height of the hoistway is increased, reloading the lifting assembly on the elevator car from the jumping platform and further lifting the elevator car after lifting the jumping platform so as to extend its traveling distance in the hoistway;

wherein the lifting assembly comprises:

a suspension beam;

a hoist detachably installed on the jumping platform or the elevator car;

a diverting pulley mounted on the suspension beam; and a hoisting member extending from the hoist, wrapping through the diverting pulley, and extending onto the jumping platform or the elevator car.

17. The jumping elevator system of claim 16, wherein the hoist is a cable climber.

* * * * *